US010897929B2

(12) United States Patent
Jochnowitz et al.

(10) Patent No.: US 10,897,929 B2
(45) Date of Patent: Jan. 26, 2021

(54) AEROSOL-GENERATING DEVICE, SYSTEM AND METHOD WITH A COMBUSTION GAS DETECTOR

(71) Applicant: Philip Morris Products S.A., Neuchatel (CH)

(72) Inventors: Evan Jochnowitz, Neuchatel (CH); Ihar Nikolaevich Zinovik, Peseux (CH); Johannes Petrus Maria Pijnenburg, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 380 days.

(21) Appl. No.: 15/519,194

(22) PCT Filed: Oct. 21, 2015

(86) PCT No.: PCT/EP2015/074420
§ 371 (c)(1),
(2) Date: Apr. 14, 2017

(87) PCT Pub. No.: WO2016/062786
PCT Pub. Date: Apr. 28, 2016

(65) Prior Publication Data

US 2017/0224024 A1 Aug. 10, 2017

(30) Foreign Application Priority Data

Oct. 24, 2014 (EP) ..... 14190272

(51) Int. Cl.
*A24F 47/00* (2020.01)
*H05B 1/02* (2006.01)

(52) U.S. Cl.
CPC ..... *A24F 47/008* (2013.01); *A24F 47/002* (2013.01); *A24F 47/004* (2013.01); *A24F 47/00* (2013.01); *H05B 1/0244* (2013.01)

(58) Field of Classification Search
CPC .. A61M 16/10; A61M 15/06; A61M 16/1045; A61M 2016/102; A61M 11/041;
(Continued)

(56) References Cited

U.S. PATENT DOCUMENTS 3,693,327 A 9/1972 Scheinberg
4,071,037 A 1/1978 Scheinberg
(Continued)

FOREIGN PATENT DOCUMENTS

CN 1287699 C 12/2006
CN 102680302 A 9/2012
(Continued)

OTHER PUBLICATIONS

International Search Report and Written Opinion dated Feb. 9, 2016 in PCT/EP2015/074420, filed Oct. 21, 2015.
(Continued)

*Primary Examiner* — Samchuan C Yao
*Assistant Examiner* — Cana A Gallegos
(74) *Attorney, Agent, or Firm* — Oblon, McClelland, Maier & Neustadt, L.L.P.

(57) ABSTRACT

An aerosol-generating device configured to heat an aerosol-forming substrate is provided, including a power supply, a heater, a controller configured to control a supply of power from the power supply to the heater, and a combustion gas detector, wherein the controller is connected to the combustion detector and is configured to monitor a level of combustion gas based on signals from the combustion gas detector.

14 Claims, 4 Drawing Sheets

(58) Field of Classification Search
CPC ..... A24F 47/00; A24F 47/002; A24F 47/004; A24F 47/008; H05B 1/0244
See application file for complete search history.

(56) References Cited

U.S. PATENT DOCUMENTS

| | | | | |
|---|---|---|---|---|
| 4,140,003 | A | 2/1979 | Pillsbury, Jr. et al. | |
| 5,944,025 | A | 8/1999 | Cook et al. | |
| 6,095,153 | A | 8/2000 | Kessler et al. | |
| 7,610,919 | B2 | 11/2009 | Utley et al. | |
| 2007/0255160 | A1* | 11/2007 | Daly | A61M 16/0045 600/529 |
| 2008/0211678 | A1* | 9/2008 | Andres | G08B 17/00 340/603 |
| 2008/0303678 | A1 | 12/2008 | McCredy | |
| 2010/0273122 | A1 | 10/2010 | Vilshenker et al. | |
| 2012/0251963 | A1* | 10/2012 | Barker | F23N 5/003 432/1 |
| 2013/0174842 | A1* | 7/2013 | Young | A61L 9/032 128/203.14 |
| 2013/0340750 | A1 | 12/2013 | Thorens et al. | |
| 2014/0230815 | A1* | 8/2014 | Gribb | A61M 16/10 128/203.12 |
| 2014/0345633 | A1* | 11/2014 | Talon | A24F 47/008 131/329 |
| 2015/0208727 | A1 | 7/2015 | Kuczaj | |
| 2015/0230521 | A1 | 8/2015 | Talon | |
| 2016/0309779 | A1* | 10/2016 | Liu | A24F 47/008 |
| 2016/0309789 | A1* | 10/2016 | Thomas, Jr. | A24F 47/008 |
| 2018/0049469 | A1* | 2/2018 | Kaufman | A61M 15/06 |

FOREIGN PATENT DOCUMENTS

| | | | |
|---|---|---|---|
| CN | 203192181 | U | 9/2013 |
| CN | 103945716 | A | 7/2014 |
| EP | 2 460 423 | A1 | 6/2012 |
| EP | 2 687 156 | A1 | 1/2014 |
| JP | 55-35483 | | 3/1980 |
| JP | 5-8372 | | 1/1993 |
| JP | 2005-517421 | | 6/2005 |
| WO | WO 98/28994 | A1 | 7/1998 |
| WO | WO 2013/098397 | A2 | 7/2013 |
| WO | WO 20131098398 | A2 | 7/2013 |
| WO | WO 2014/102091 | A1 | 7/2014 |

OTHER PUBLICATIONS

International Preliminary Report on Patentability and Written Opinion of the International Searching Authority dated May 4, 2017 in PCT/EP2015/074420 filed Oct. 21, 2015.

Combined Chinese Office Action and Search Report dated Apr. 19, 2019 in Chinese Patent Application No. 201580054472.8 (with English translation), 18 pages.

Israeli Office Action dated Dec. 10, 2019 in corresponding Israel Patent Application No. 249904 and English translation, (7 pages).

English translation of Japanese Office Action dated Nov. 7, 2019 in corresponding Japanese Patent Application No. 2017-520473 (4 pages).

Japanese Office Action dated Nov. 7, 2019 in corresponding Japanese Patent Application No. 2011-520473, (3 pages).

Combined Chinese Office Action and Search Report dated Mar. 3, 2020 in corresponding Chinese Patent Application No. 201580054472.8 (with English Translation of Category of Cited Documents), 5 pages.

Japanese Office Action dated Jun. 11, 2020 in Patent Application No. 2017-520473.

* cited by examiner

AEROSOL-GENERATING DEVICE, SYSTEM AND METHOD WITH A COMBUSTION GAS DETECTOR

The invention relates to aerosol-generating devices and systems which operate by heating an aerosol-forming substrate. In particular the invention relates to aerosol generating devices and systems in which it is desirable to maintain the temperature of the aerosol-forming substrate within a temperature range in order to ensure the production of a desirable aerosol. Electrically heated smoking devices are examples of this type of device.

One potential problem with electrically heated smoking devices, whether they are configured to heat a liquid aerosol-forming substrate or a solid aerosol-forming substrate such as a cigarette, is that if the temperature of the aerosol-forming substrate gets too high then combustion of the aerosol-forming substrate can occur. This can lead to the generation of compounds within the generated aerosol that taste unpleasant and are generally undesirable.

This problem is particularly acute in systems in which the user can insert their own aerosol-forming substrate into the device. Different aerosol-forming substrates behave differently when heated. In particular the temperature at which combustion occurs will vary depending on the composition of the substrate and its moisture content. Accordingly a device that simply maintains the temperature of a heater within a predetermined temperature range may not produce desirable aerosol for all the different substrates that might be used with it.

It is an object of the present invention to provide an aerosol generating device and system that prevents the generation of high levels of undesirable aerosol constituents and that can operate with a variety of different and unknown aerosol-forming substrates.

In a first aspect there is provided an aerosol-generating device configured to heat an aerosol-forming substrate, comprising:

a power supply;

a heater;

a controller configured to control the supply of power from the power supply to the heater; and a combustion gas detector, wherein the controller is connected to the combustion detector and is configured to monitor a level of combustion gas based on signals from the combustion gas detector.

By monitoring the level of combustion gases generated, the controller has information about the composition of the aerosol being generated without needing to know anything about the aerosol-forming substrate being used. The combustion gas detector may be, for example, a carbon monoxide (CO) or nitric oxide ($NO_x$) detector. Carbon monoxide is an established indicator of combustion and in particular of incomplete combustion. For example, in a burning cigarette heavier molecular weight volatile compounds are "cracked" into smaller molecules, such as low molecular weight hydrocarbons, carbon monoxide and carbon dioxide. Incomplete combustion can occur because during use, particularly between user puffs, insufficient oxygen is transported to the burning cigarette for complete combustion. Nitric oxide is often produced during combustion too. Nitric oxide includes both nitric oxide (NO) and nitrogen dioxide (NO2) but is often abbreviated to $NO_x$. In burning biomass $NO_x$ typically results from fuel bound nitrogen. For example plant based substrates, such as tobacco based substrates contain significant amount of nitrates. The combustion gas detector may also be detector configured to detect other gases, such as gases containing a carboxyl group or carboxyl groups, or aldehydes, which may be undesirably generated in electronic cigarettes using a liquid substrate, as a result of combustion of constituents of the liquid substrate.

As used herein the term "level of combustion gases" may refer to a concentration of combustion gases within an airflow or an absolute amount of combustion gases detected.

The controller may be configured to reduce the supply of power to the heater when the level of combustion gas exceeds a first threshold gas level. Preferably, the controller is configured to reduce power to the heater to a level that has the effect of reducing the temperature of the heater or aerosol-forming substrate.

Alternatively, or in addition, the device may comprise an indicator, and the controller may be configured to activate the indicator when the level of combustion gas exceeds a second threshold level. The indicator may be a visual indicator on the device such as a light emitting diode (LED) or an audible indicator, such as a speaker. The user may then choose to discontinue using the device until the indicator is deactivated. The first threshold level may be the same as or different to the second threshold level.

As used herein, an 'aerosol-generating device' relates to a device that interacts with an aerosol-forming substrate to generate an aerosol. The aerosol-forming substrate may be part of an aerosol-generating article, for example part of a smoking article. An aerosol-generating device may be a smoking device that interacts with an aerosol-forming substrate of an aerosol-generating article to generate an aerosol that is directly inhalable into a user's lungs thorough the user's mouth.

As used herein, the term 'aerosol-forming substrate' relates to a substrate capable of releasing volatile compounds that can form an aerosol. Such volatile compounds may be released by heating the aerosol-forming substrate. An aerosol-forming substrate may conveniently be part of an aerosol-generating article or smoking article.

As used herein, the terms 'aerosol-generating article' and 'smoking article' refer to an article comprising an aerosol-forming substrate that is capable of releasing volatile compounds that can form an aerosol. For example, an aerosol-generating article may be a smoking article that generates an aerosol that is directly inhalable into a user's lungs through the user's mouth. An aerosol-generating article may be disposable. A smoking article may be, or may comprise, a tobacco stick.

The device may be an electrically operated device and in particular may be an electrically heated smoking device.

The controller may be configured to calculate a cumulative or average combustion gas level over a predetermined period of time and compare the cumulative or average combustion gas level with the threshold level or threshold levels. Using combustion gas level data collected over a predetermined time period, for example 5 or 10 seconds, reduces the likelihood of a false positive result. The controller may be configured to continuously monitor the combustion gas level and calculate a rolling average based on the combustion gas level data received over the preceding predetermined time period.

The controller is configured to stop the supply of power to the heater from the power source when the combustion gas level reaches a stop level. The stop level may the same as or different to the second threshold level. In one embodiment the stop level is higher than the first threshold level.

The controller may be configured to monitor the level of combustion gas after the controller has stopped the supply of power to the heater and may be configured to activate an indicator if the combustion gas level remains above the stop level. This indicator can be audio or visual and can be different to the indicator activated when the combustion gas level exceeds the second threshold. This allows for the detection of self-perpetuating combustion within the substrate. If the heat generated by the combustion is sufficient to cause further combustion, without additional heat from the heater, then the user is alerted and can choose to remove the substrate from the device.

The controller may be configured to regulate the supply of power to the heater from the power supply to maintain the level of combustion gas below the first threshold level. A feedback loop may be used so that the controller continuously adjusts the power supplied to the heater dependent on the level of combustion gas detected. By reducing power to the heater, the level of combustion gas generated can be reduced. The amount of power reduction may be a predetermined amount or may be a reduction that is controlled based on a sensed temperature. As before, the controller may calculate a cumulative or average combustion gas level to compare with the first threshold level. This control loop can be used in conjunction with other control loops and control strategies for regulating the power supplied to the heater, which may be based on sensed temperature, the electrical resistance of the heater and sensed airflow rate, for example.

The device may comprise an air inlet and an air outlet, and, in use, the aerosol-forming substrate may be positioned in an air flow path between air inlet and the air outlet. Air is drawn in through the air inlet, past or through the aerosol-forming substrate to the air outlet. In a smoking system, the user puffs on the air outlet to draw air and generated aerosol (smoke) into their mouth.

The combustion gas detector may be positioned to detect combustion gases drawn into the device through the air inlet, herein referred to as sidestream combustion gas. In a smoking system, this allows the detection of combustion gases within "sidestream" smoke, which is not directly inhaled by the user.

Alternatively, the combustion gas detector may be positioned to detect combustion gases adjacent to or downstream of the aerosol-forming substrate, herein referred to as mainstream combustion gas. In a smoking system, this allows the detection of combustion gases within "mainstream" smoke, which is directly inhaled by the user.

The threshold levels of combustion gas used for determining whether to reduce or stop the supply of power to the heater, and to determine whether to activate an indicator, depend on whether the combustion gas detector is positioned to detect sidestream combustion gas or mainstream combustion gas.

If the combustion gases detector is configured to detect sidestream CO, the first, second and stop thresholds may be between 0.002 and 0.02 mg of CO per second, and preferably between 0.004 and 0.009 mg of CO per second.

If the combustion gases detector is configured to detect sidestream $NO_x$, the first, second and stop thresholds may be between 0.9 and 4.2 μg of NO per second and preferably between 1.8 and 3.7 μg of $NO_x$ per second.

If the combustion gases detector is configured to detect sidestream NO alone, the first, second and stop thresholds may between 0.9 and 4.2 μg of NO per second and preferably between 1.8 and 3.7 μg of NO per second.

If the combustion gases detector is configured to detect mainstream CO, the first, second and stop thresholds may be between 0.01 and 0.09 mg of CO per second and preferably between 0.02 and 0.04 mg of CO per second.

If the combustion gases detector is configured to detect mainstream $NO_x$, the first, second and stop thresholds may be between 0.4 and 1.6 μg of $NO_x$ per second and preferably between 0.7 and 01.4 μg of $NO_x$ per second.

If the combustion gases detector is configured to detect mainstream NO, the first, second and stop thresholds may be between 0.4 and 1.6 μg of NO per second and preferably between 0.7 and 01.4 μg of NO per second.

In all cases, the stop threshold may be greater than the first and second thresholds.

The heater may comprise a heating element formed from an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum platinum, gold and silver. Examples of suitable metal alloys include stainless steel, nickel-, cobalt-, chromium-, aluminium- titanium- zirconium-, hafnium-, niobium-, molybdenum-, tantalum-, tungsten-, tin-, gallium-, manganese-, gold- and iron-containing alloys, and super-alloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required.

In both the first and second aspects of the invention, the heater may comprise an internal heating element or an external heating element, or both internal and external heating elements, where "internal" and "external" refer to the aerosol-forming substrate. An internal heating element may take any suitable form. For example, an internal heating element may take the form of a heating blade. Alternatively, the internal heater may take the form of a casing or substrate having different electro-conductive portions, or an electrically resistive metallic tube. Alternatively, the internal heating element may be one or more heating needles or rods that run through the centre of the aerosol-forming substrate. Other alternatives include a heating wire or filament, for example a Ni—Cr (Nickel-Chromium), platinum, tungsten or alloy wire or a heating plate. Optionally, the internal heating element may be deposited in or on a rigid carrier material. In one such embodiment, the electrically resistive heating element may be formed using a metal having a defined relationship between temperature and resistivity. In such an exemplary device, the metal may be formed as a track on a suitable insulating material, such as ceramic material, and then sandwiched in another insulating material, such as a glass. Heaters formed in this manner may be used to both heat and monitor the temperature of the heating elements during operation.

An external heating element may take any suitable form. For example, an external heating element may take the form of one or more flexible heating foils on a dielectric substrate, such as polyimide. The flexible heating foils can be shaped to conform to the perimeter of the substrate receiving cavity. Alternatively, an external heating element may take the form of a metallic grid or grids, a flexible printed circuit board, a moulded interconnect device (MID), ceramic heater, flexible carbon fibre heater or may be formed using a coating technique, such as plasma vapour deposition, on a suitable shaped substrate. An external heating element may also be formed using a metal having a defined relationship between temperature and resistivity. In such an exemplary device, the metal may be formed as a track between two layers of suitable insulating materials. An external heating element formed in this manner may be used to both heat and monitor the temperature of the external heating element during operation.

The heater advantageously heats the aerosol-forming substrate by means of conduction. The heater may be at least partially in contact with the substrate, or the carrier on which the substrate is deposited. Alternatively, the heat from either an internal or external heating element may be conducted to the substrate by means of a heat conductive element.

The power supply may be any suitable power supply, for example a DC voltage source. In one embodiment, the power supply is a Lithium-ion battery. Alternatively, the power supply may be a Nickel-metal hydride battery, a Nickel cadmium battery, or a Lithium based battery, for example a Lithium-Cobalt, a Lithium-Iron-Phosphate, Lithium Titanate or a Lithium-Polymer battery.

The controller may comprise a microcontroller. The microcontroller may include a PID regulator for controlling the power supplied to the heater. The controller may be configured to supply power to the heater as pulses of electrical power. The controller may be configured to alter the supply of power to the heater by altering the duty cycle of the pulses of power.

Preferably, the controller is configured to perform the method steps of the third aspect of the invention, set out below. To perform the method steps of the third aspect of the invention, the controller may be hardwired. More preferably, however, the controller is programmable to perform the method steps of the third aspect of the invention.

The combustion gas detector is preferably a miniature detector.

The aerosol generating device may comprise a housing. Preferably, the housing is elongate. The structure of the housing, including the surface area available for condensation to form, will affect the aerosol properties and whether there is liquid leakage from the device. The housing may comprise a shell and a mouthpiece. In that case, all the components may be contained in either the shell or the mouthpiece. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle.

Preferably, the aerosol generating device is portable. The aerosol generating device may be a smoking device and may have a size comparable to a conventional cigar or cigarette. The smoking device may have a total length between approximately 30 mm and approximately 150 mm. The smoking device may have an external diameter between approximately 5 mm and approximately 30 mm.

In a second aspect, there is provided an aerosol generating system comprising an aerosol-generating device according to the first aspect and an aerosol-forming substrate received in or coupled to the device.

In both the first and second aspects of the invention, during operation, the aerosol-forming substrate may be completely contained within the aerosol-generating device. In that case, a user may puff on a mouthpiece of the aerosol-generating device.

Alternatively, during operation a smoking article containing the aerosol-forming substrate may be partially contained within the aerosol-generating device. In that case, the user may puff directly on the smoking article. The heating element may be positioned within a cavity in the device, wherein the cavity is configured to receive an aerosol-forming substrate such that in use the heating element is within the aerosol-forming substrate.

The smoking article may be substantially cylindrical in shape. The smoking article may be substantially elongate. The smoking article may have a length and a circumference substantially perpendicular to the length. The aerosol-forming substrate may be substantially cylindrical in shape. The aerosol-forming substrate may be substantially elongate. The aerosol-forming substrate may also have a length and a circumference substantially perpendicular to the length.

The smoking article may have a total length between approximately 30 mm and approximately 100 mm. The smoking article may have an external diameter between approximately 5 mm and approximately 12 mm. The smoking article may comprise a filter plug. The filter plug may be located at the downstream end of the smoking article. The filter plug may be a cellulose acetate filter plug. The filter plug is approximately 7 mm in length in one embodiment, but may have a length of between approximately 5 mm to approximately 10 mm.

In one embodiment, the smoking article has a total length of approximately 45 mm. The smoking article may have an external diameter of approximately 7.2 mm. Further, the aerosol-forming substrate may have a length of approximately 10 mm. Alternatively, the aerosol-forming substrate may have a length of approximately 12 mm. Further, the diameter of the aerosol-forming substrate may be between approximately 5 mm and approximately 12 mm. The smoking article may comprise an outer paper wrapper. Further, the smoking article may comprise a separation between the aerosol-forming substrate and the filter plug. The separation may be approximately 18 mm, but may be in the range of approximately 5 mm to approximately 25 mm. The separation is preferably filled in the smoking article by a heat exchanger that cools the aerosol as it passes through the smoking article from the substrate to the filter plug. The heat exchanger may be, for example, a polymer based filter, for example a crimped PLA material.

In both the first and second aspects of the invention, the aerosol-forming substrate may be a solid aerosol-forming substrate. Alternatively, the aerosol-forming substrate may comprise both solid and liquid components. The aerosol-forming substrate may comprise a tobacco-containing material containing volatile tobacco flavour compounds which are released from the substrate upon heating. Alternatively, the aerosol-forming substrate may comprise a non-tobacco material. The aerosol-forming substrate may further comprise an aerosol former. Examples of suitable aerosol formers are glycerine and propylene glycol.

If the aerosol-forming substrate is a solid aerosol-forming substrate, the solid aerosol-forming substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco, cast leaf tobacco and expanded tobacco. The solid aerosol-forming substrate may be in loose form, or may be provided in a suitable container or cartridge. Optionally, the solid aerosol-forming substrate may contain additional tobacco or non-tobacco volatile flavour compounds, to be released upon heating of the substrate. The solid aerosol-forming substrate may also contain capsules that, for example, include the additional tobacco or non-tobacco volatile flavour compounds and such capsules may melt during heating of the solid aerosol-forming substrate.

As used herein, homogenised tobacco refers to material formed by agglomerating particulate tobacco. Homogenised tobacco may be in the form of a sheet. Homogenised tobacco material may have an aerosol-former content of greater than 5% on a dry weight basis. Homogenised tobacco material may alternatively have an aerosol former content of between 5% and 30% by weight on a dry weight basis. Sheets of homogenised tobacco material may be formed by agglomerating particulate tobacco obtained by grinding or otherwise comminuting one or both of tobacco leaf lamina and tobacco leaf stems. Alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco; alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof.

Optionally, the solid aerosol-forming substrate may be provided on or embedded in a thermally stable carrier. The carrier may take the form of powder, granules, pellets, shreds, spaghettis, strips or sheets. Alternatively, the carrier may be a tubular carrier having a thin layer of the solid substrate deposited on its inner surface, or on its outer surface, or on both its inner and outer surfaces. Such a tubular carrier may be formed of, for example, a paper, or paper like material, a non-woven carbon fibre mat, a low mass open mesh metallic screen, or a perforated metallic foil or any other thermally stable polymer matrix.

The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

Although reference is made to solid aerosol-forming substrates above, it will be clear to one of ordinary skill in the art that other forms of aerosol-forming substrate may be used with other embodiments. For example, the aerosol-forming substrate may be a liquid aerosol-forming substrate. The liquid aerosol-forming substrate may comprise an aerosol former. Examples of suitable aerosol formers are glycerine and propylene glycol. If a liquid aerosol-forming substrate is provided, the aerosol-generating device preferably comprises means for retaining the liquid. For example, the liquid aerosol-forming substrate may be retained in a container. Alternatively or in addition, the liquid aerosol-forming substrate may be absorbed into a porous carrier material. The porous carrier material may be made from any suitable absorbent plug or body, for example, a foamed metal or plastics material, polypropylene, terylene, nylon fibres or ceramic. The liquid aerosol-forming substrate may be retained in the porous carrier material prior to use of the aerosol-generating device or alternatively, the liquid aerosol-forming substrate material may be released into the porous carrier material during, or immediately prior to use. For example, the liquid aerosol-forming substrate may be provided in a capsule. The shell of the capsule preferably melts upon heating and releases the liquid aerosol-forming substrate into the porous carrier material. The capsule may optionally contain a solid in combination with the liquid.

Alternatively, the carrier may be a non-woven fabric or fibre bundle into which tobacco components have been incorporated. The non-woven fabric or fibre bundle may comprise, for example, carbon fibres, natural cellulose fibres, or cellulose derivative fibres.

In a third aspect of the invention, there is provided a method of controlling the supply of power to a heater in a heated aerosol-generating device comprising:

monitoring a level of combustion gases in or around the device; and reducing the supply of power to the heater if the level of combustion gases exceeds a first threshold level of combustion gases.

The method may further comprise activating an indicator on the device if the level of combustion gases exceeds a second threshold level of combustion gases.

The method may further comprise controlling the supply of power to the heater to maintain the level of combustion gases below a first threshold level.

The method may comprise calculating a cumulative or average combustion gas level over a predetermined period of time and comparing the cumulative or average combustion gas level with the first threshold level or threshold levels. Using combustion gas level data collected over a predetermined time period, for example 5 or 10 seconds, reduces the likelihood of a false positive result. The method may comprise continuously monitoring the combustion gas level and calculating a rolling average based on the combustion gas level data received over the preceding predetermined time period.

The method may comprise stopping the supply of power to the heater from the power source when the combustion gas level reaches a stop level. The stop level may the same as or different to the second threshold level. In one embodiment the stop level is higher than the first threshold level.

The method may comprise monitoring the level of combustion gas after stopping the supply of power to the heater and activating an indicator if the combustion gas level remains above the stop level. This indicator can be audio or visual and can be different to the indicator activated when the combustion gas level exceeds the second threshold.

Although the disclosure has been described by reference to different aspects, it should be clear that features described in relation to one aspect of the disclosure may be applied to the other aspects of the disclosure.

The invention will be further described, by way of example only, with reference to the accompanying drawings, in which.

Figure 1:
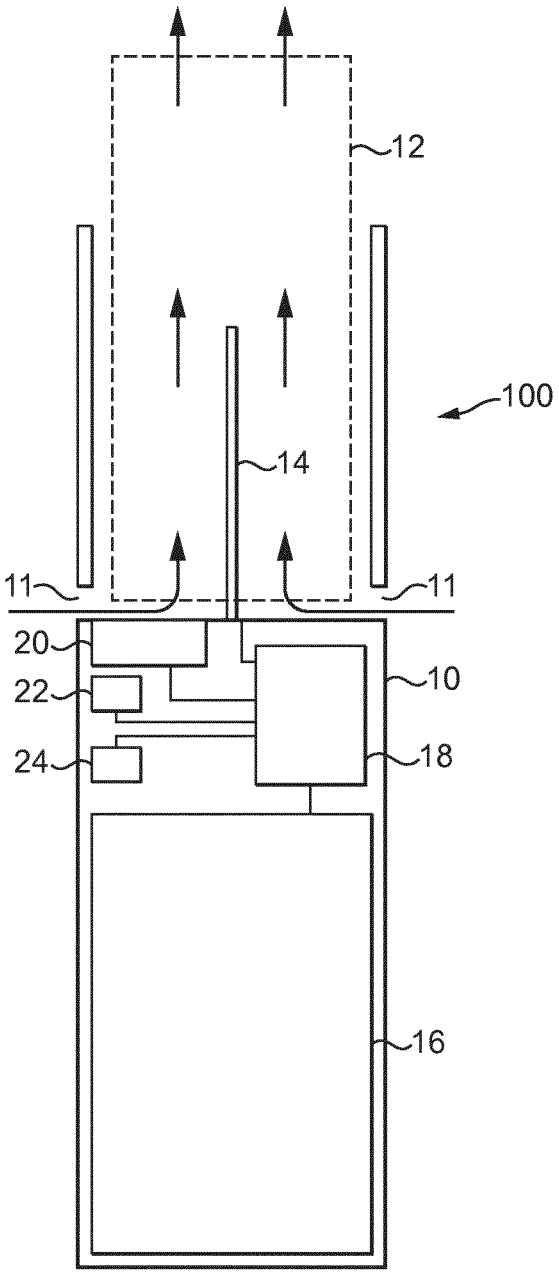
FIG. 1 is a schematic illustration of a first electrically heated smoking device in accordance with the invention.

In FIG. 1, the components of an embodiment of an electrically heated aerosol-generating device 100 are shown in a simplified manner. Particularly, the elements of the electrically heated aerosol-generating device 100 are not drawn to scale in FIG. 1. Elements that are not relevant for the understanding of this embodiment have been omitted to simplify FIG. 1.

The electrically heated aerosol-generating device 100 comprises a housing 10 and an aerosol-forming substrate 12, for example a cigarette. The aerosol-forming substrate 12 is pushed inside the housing 10 to come into thermal proximity with the heater 14. The aerosol-forming substrate 12 will release a range of volatile compounds at different temperatures. By controlling the operation temperature of the electrically heated aerosol-generating device 100 to be below the release temperature of some of the volatile compounds, the release or formation of these smoke constituents can be avoided.

Within the housing 10 there is an electrical energy supply 16, for example a rechargeable lithium ion battery. A controller 18 is connected to the heating element 14 and the electrical energy supply 16. The controller 18 controls the power supplied to the heating element 14 in order to regulate its temperature. Typically the aerosol-forming substrate is heated to a temperature of between 250 and 450 degrees centigrade.

The housing 10 includes air inlets 11 at the base of the cavity in housing that received the aerosol-forming substrate 12. In use, a user puffs on the cigarette and draws air through the air inlets 11, through the substrate 12 past the heater 14, and into their mouth.

In the described embodiment the heating element 14 is an electrically resistive track or tracks deposited on a ceramic substrate. The ceramic substrate is in the form of a blade and is inserted into the aerosol-forming substrate 12 in use.

The controller 18 is also connected to a combustion gas detector 20, in this example a carbon monoxide (CO) detector. The controller is also connected to a visual indicator 22, which in this example is an LED, and an audio indicator 24, which in this example is a speaker configured to emit a warning sound, as will be described.

In the example shown in FIG. 1, the combustion gas detector is positioned to detect CO in the airflow drawn in through the air inlets. This is the sidestream smoke. The combustion gas detector 20 continuously provides the controller with a signal indicative of a sensed level of CO in the sidestream smoke.

Figure 2:
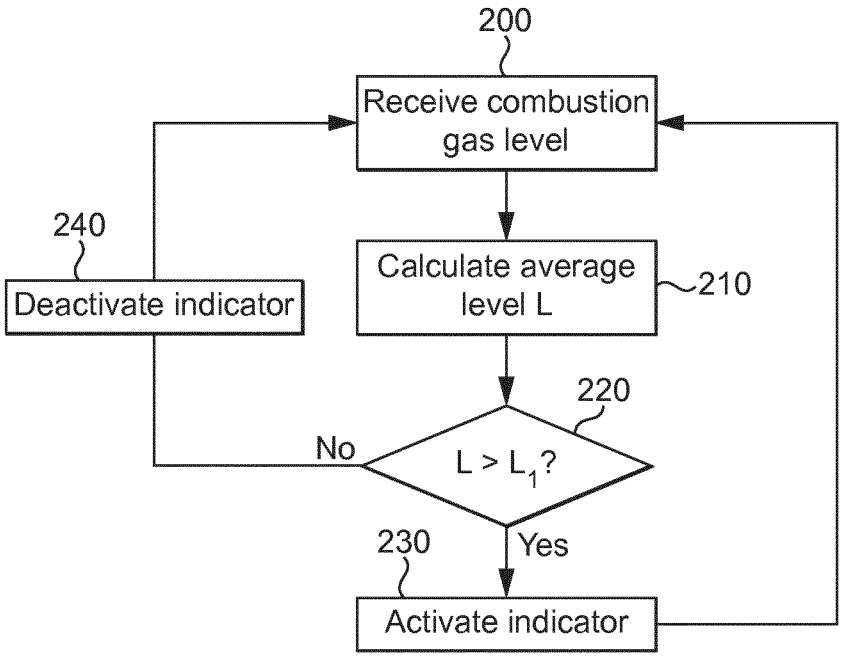
FIG. 2 is a flow diagram illustrating one use for the combustion gas level information provided by the combustion gas detector.

FIG. 2 illustrates a first process in which the controller 18 uses the combustion gas level from the detector. In a first step 200, the controller receives a combustion gas level signal from the detector 20. The combustion gas level signal may be sampled every clock cycle of the controller and a digital value of the combustion gas level stored in memory. The memory may be a volatile memory or a non-volatile memory within the controller. In a second step 210, the controller calculates an average combustion gas level using the signals received from the detector over the preceding five seconds. Using data collected over a significant time period reduces the likelihood of a false positive result based on random spikes in the level of combustion gas detected. The average level of combustion gas over the preceding five seconds is labelled L in FIG. 2.

A threshold level of combustion gases above which the user is to be warned is stored in a non-volatile memory within the controller. This level is a level which is likely to be the result of significant combustion of the aerosol-forming substrate. This is indicated as $L_1$ in FIG. 2. In step 220, the controller compares the calculated average combustion gas level L with $L_1$. If L is greater than $L_1$ then the controller proceeds to step 230. In step 230 the controller activates indicator 22 or indicator 24 (if it is not already activated) to alert the user that combustion is taking place. The user can then choose to stop puffing on the cigarette or modify their puffing behaviour to allow for the substrate to cool, or may choose to continue to puff in the same manner. The controller then returns to step 200 to start the process again.

If in step 220 the controller determines that that the average level of combustion gas for the preceding five seconds is less than $L_1$ then the controller proceeds to step 240. In step 240 the indicator 22 is deactivated (if it is not already deactivated), and the process then returns to step 200.

In this way the system provides the user with information about combustion occurring within the aerosol-forming substrate.

In this example the combustion gas detector is CO detector and it is positioned to measure CO levels in the sidestream smoke. The level of threshold $L_1$ is set at a level above the level of CO normally expected during non-combusting use of the device. The average amount of CO detected in sidestream smoke of a conventional cigarette which is combusted is around 0.02 mg/s. The threshold $L_1$ is set well below that, at between 0.004 and 0.009 mg/s. The user will therefore receive a warning well before full, self-perpetuating combustion of the aerosol-forming substrate has occurred.

Alternatively, or in addition, an NO or $NO_x$ detector could be used. Again the threshold level used for NO and $NO_x$ is above the level expected during normal non-combusting operation of the system, but well below the level of NO or $NO_x$ produced from combustion of a conventional cigarette. The threshold level $L_1$ for both NO and $NO_x$ in this embodiment would be between 1.8 and 3.7 μg/s.

Figure 3:
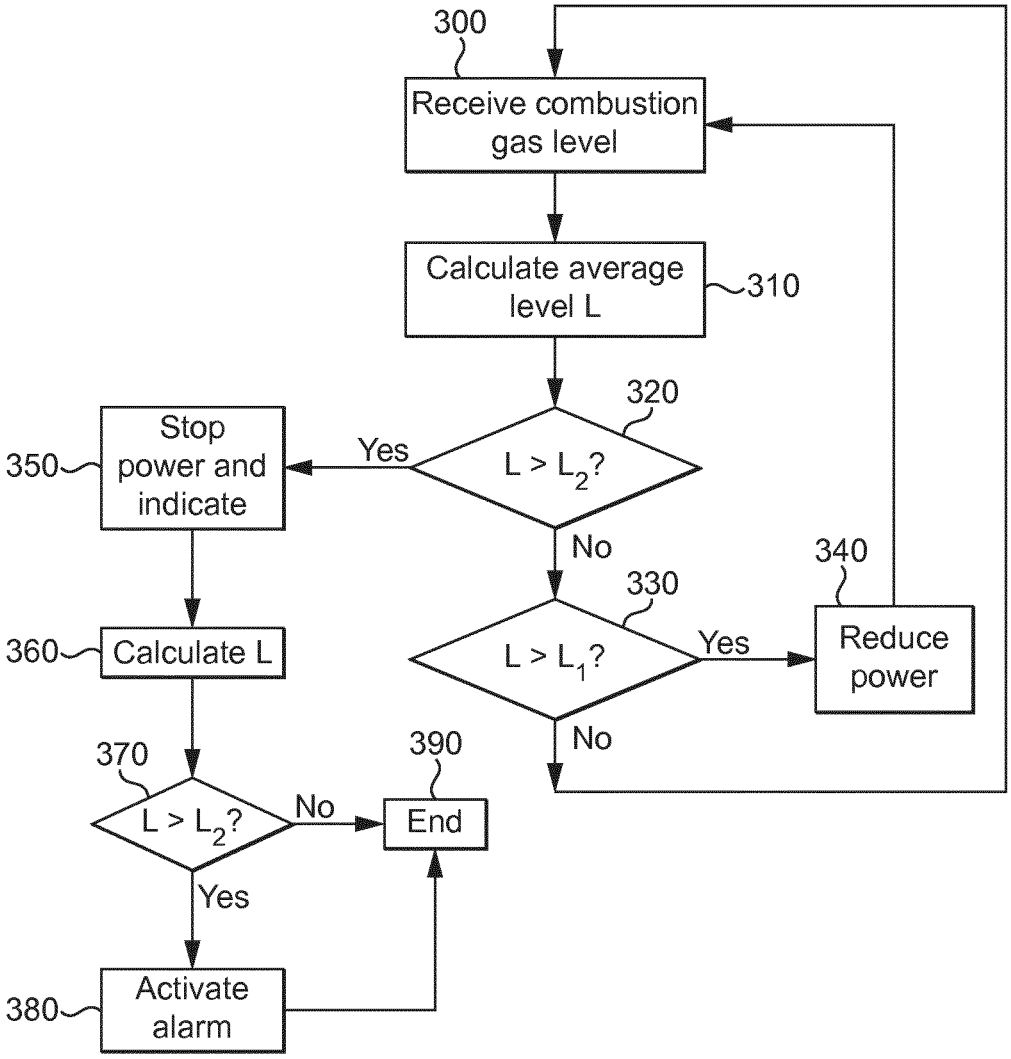
FIG. 3 is a flow diagram illustrating another use for the combustion gas level information provided by the combustion gas detector.

FIG. 3 illustrates a more complex process that can be carried out by the controller 18 using the combustion gas level from the detector 20. In a first step 300, the controller receives a combustion gas level signal from the detector 20. The combustion gas level signal may be sampled every clock cycle of the controller and a digital value of the combustion gas level stored in memory. The memory may be a volatile memory or a non-volatile memory within the controller. In a second step 310, the controller calculates an average combustion gas level using the signals received from the detector over the preceding five seconds. The average level of combustion gas over the preceding five seconds is again labelled L in FIG. 3.

In step 320, the controller 18 compares the average combustion gas level L with a stop threshold level $L_2$. The stop threshold level is a relatively high level of combustion gas above which power to the heater is stopped, as will be described. If the average combustion gas level L not greater than $L_2$ then the controller moves to step 330 where L is compared to a lower threshold $L_1$. $L_1$ is set at about the same level as $L_1$ in the process of FIG. 2, and is a level below which it is desirable to keep combustion gas levels. If in step 330 it is determined by the controller than L is not greater than $L_1$ then the controller returns to step 300 without activating nay indicators or adjusting the power supplied to the heater. But if in step 330 the controller determines that L is greater than $L_1$ then the controller reduces the power supplied to heater, in this example by reducing the duty cycle of the power pulses supplied to the heater. The controller then returns to step 300 and the cycle is repeated. This feedback between combustion gas level and power will have the effect of reducing power until the level of combustion gas detected is below $L_1$ and will in normal operation maintain the level of combustion gases below $L_1$.

If in step 320 the controller determines that L is greater than $L_2$ then the controller stops the supply of power to the heater and activates indicator 22. $L_2$ is set at a higher level than $L_1$. For sidestream smoke, and for CO detection, $L_2$ may be set at around 0.01 mg/s. If level $L_2$ is exceeded it is indicative of a significant level of combustion occurring that will likely lead to significant amounts of other undesirable constituents in the aerosol. For an NO or $NO_x$ detector the threshold $L_2$ is set at around 4 μg/s.

To determine whether combustion is still occurring in the aerosol-forming substrate even after power to the heater has been stopped, in step 360 the controller recalculates L. Step 360 may be carried out a predetermined time after step 350, say 5 seconds after step 350. In step 370 the recalculated L is again compared with $L_2$. If L remains higher than $L_2$ then it is indicative of self-perpetuating combustion occurring in the aerosol-forming substrate. Then in step 380 the audio indicator 24 is activated to indicate to the user that the substrate should not be re-used and that they should remove the substrate from the device. The process ends at step 390 and device switched off. If the recalculated L is lower than $L_2$ then the controller proceeds directly from step 370 to step 390 and the device is powered off.

The process described with reference to FIGS. 2 and 3 may be particularly necessary when it is possible for the end user to use an aerosol-forming substrate of their choosing in the device rather than aerosol-forming substrates specifically designed for use with the device and approved by the manufacturer. Cigarettes used in heated tobacco products typically contain glycerol or another aerosol-former and so have a relatively high moisture content compared to conventional cigarettes and loose cut tobacco, particularly if the cigarettes of tobacco are old. Dry aerosol-forming substrates will combust at lower temperatures than relatively moister substrates. Furthermore, the amount of aerosol-forming substrate loaded into the device will affect the amount of power required for the heater to reach a given temperature.

Figure 4:
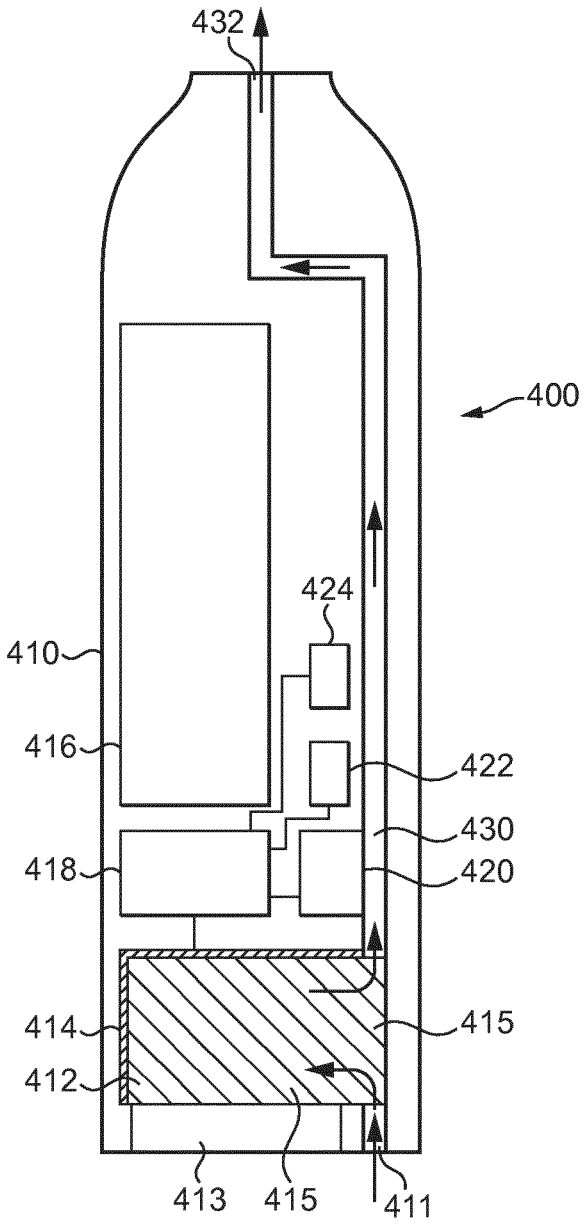
FIG. 4 is a schematic illustration of an alternative heated smoking device in accordance with the invention.

FIG. 4 illustrates an alternative type of smoking system in accordance with the invention, which allows users to use loose tobacco or other substrates in the device. The device 400 comprises an oven chamber 415 in which loose tobacco 412 is loaded. The oven is heated by a flexible heater 414 lining the oven chamber 414. A controller 418 controls the supply of electrical power from a battery 410 to the heater 414. The controller is also connected to a CO detector 420, an LED indicator 422 and an audio indicator 424, as described in the device of FIG. 1. Loose tobacco can be loaded into the oven by removing lid 413, loading an amount of tobacco into the oven chamber and then replacing the lid.

The device 400 has a mouthpiece 432 on which a user puffs to draw air and generated aerosol through the device. Air is drawn into the device through air inlet 411 into the oven chamber, the air then flows through conduit 430, past the CO detector 420 to the mouthpiece 432 and then into a user's mouth. Filter elements (not shown) can be provided in inlet 411 and at the entrance to conduit 430 to prevent tobacco blocking the airflow path.

Vapours from the heated aerosol-generating substrate are entrained in the airflow and drawn through the conduit, past the CO detector with the air. The vapours condense in the airflow to form an aerosol.

It can be seen in this embodiment that the combustion gas detector 420 is configured to detect the gases that are passed directly into the user's mouth, downstream of the aerosol-forming substrate. This is called the mainstream smoke. Because the combustion gas detector in this embodiment detects mainstream smoke the threshold levels used in the process of FIG. 2 and FIG. 3 need to be set higher than they do for a device of the type described in FIG. 1 in which the combustion gas detector is positioned to detect sidestream smoke.

In this example the combustion gas detector is CO detector and the level of threshold $L_1$ is set at a level above the level of CO normally expected during non-combusting use of the device. The average amount of CO detected in mainstream smoke of a conventional cigarette which is combusted is around 0.09 mg/s. The threshold $L_1$ for mainstream smoke is therefore set well below that, at between 0.02 and 0.04 mg/s. The threshold for level $L_2$ is set at around 0.07 mg/s.

Alternatively, or in addition, an NO or an $NO_x$ detector could be used. Again the threshold level used for NO and $NO_x$ is above the level expected during normal non-combusting operation of the system, but well below the level of NO or $NO_x$ produced from combustion of a conventional cigarette. The threshold level $L_1$ for both NO and $NO_x$ in this embodiment, detecting mainstream smoke, would be between 0.7 and 1.4 μg/s. The threshold level for $L_2$ could be set at around 1.5 μg/s.

It should be clear that, the exemplary embodiments described above illustrate but are not limiting. In view of the above discussed exemplary embodiments, other embodiments consistent with the above exemplary embodiments will now be apparent to one of ordinary skill in the art.

The invention claimed is:

1. An aerosol-generating device, comprising:

a power supply;

a heater configured to heat an aerosol-forming substrate to form an aerosol;

a controller configured to control a supply of power from the power supply to the heater; and a combustion gas detector configured to generate a signal indicating a level of a combustion gas, wherein the controller is connected to the combustion gas detector and is further configured to receive the signal from the combustion gas detector, stop the supply of power to the heater from the power supply when a level of combustion gas reaches a stop level, monitor the level of combustion gas after the controller has stopped the supply of power to the heater, and to activate an indicator if the level of combustion gas remains above the stop level, and activate another indicator when the level of combustion gas exceeds a threshold gas level.

2. The aerosol-generating device according to claim 1, wherein the controller is further configured to reduce the supply of power to the heater when a level of combustion gas exceeds a first another threshold gas level.

3. The aerosol-generating device according to claim 1, wherein the device is an electrically heated smoking device.

4. The aerosol-generating device according to claim 1, wherein the combustion gas detector is a carbon monoxide (CO) detector or a nitric oxide ($NO_x$) detector.

5. The aerosol-generating device according to claim 1, wherein the controller is further configured to calculate a cumulative or average combustion gas level over a predetermined period of time and to compare the calculated cumulative or average combustion gas level with at least one threshold gas level.

6. The aerosol-generating device according to claim 1, wherein the controller is further configured to regulate the supply of power to the heater from the power supply to maintain a level of combustion gas below a first threshold gas level.

7. The aerosol-generating device according to claim 1, further comprising an air inlet and an air outlet, wherein the aerosol-forming substrate is disposed in an air flow path between the air inlet and the air outlet, and wherein the combustion gas detector is positioned so as to detect combustion gas drawn in through the air inlet and upstream of the aerosol-forming substrate.

8. The aerosol-generating device according to claim 1, further comprising an air inlet and an air outlet, wherein the aerosol-forming substrate is disposed in an air flow path between the air inlet and the air outlet, such that air drawn in through the air inlet moves past or through the aerosol-forming substrate to the air outlet, and wherein the combustion gas detector is positioned so as to detect combustion gas adjacent to or downstream of the aerosol-forming substrate.

9. The aerosol-generating device according to claim 1, further comprising a cavity configured to receive the aerosol-forming substrate, wherein the heater is disposed within the cavity such that the heater is within the aerosol-forming substrate.

10. The aerosol-generating device according to claim 1, wherein the aerosol-generating device is configured to at least partially contain a smoking article containing the aerosol-forming substrate such that a user may puff directly on the smoking article.

11. An aerosol generating system, comprising:

an aerosol-generating article comprising an aerosol-forming substrate; and an aerosol-generating device configured to removably receive or couple to the aerosol-generating article, the device comprising:

a power supply;

a heater configured to heat an aerosol-forming substrate to form an aerosol;

a controller configured to control a supply of power from the power supply to the heater; and a combustion gas detector configured to generate a signal indicating a level of a combustion gas, wherein the controller is connected to the combustion gas detector and is further configured to receive the signal from the combustion gas detector, stop the supply of power to the heater from the power supply when a level of combustion gas reaches a stop level, monitor the level of combustion gas after the controller has stopped the supply of power to the heater, and to activate an indicator if the level of combustion gas remains above the stop level, and activate another indicator when the level of combustion gas exceeds a threshold gas level.

12. The aerosol-generating system according to claim 11, wherein the aerosol-forming substrate comprises a tobacco-containing material including volatile tobacco flavor compounds, which are released from said substrate upon heating.

13. The aerosol-generating system according to claim 12, wherein the aerosol-forming substrate is a solid substrate.

14. A method of controlling a supply of power to a heater in a heated aerosol-generating device, the heater being configured to heat an aerosol-forming substrate to form an aerosol, the method comprising:

monitoring a level of a combustion gas in or around the device;

stop the supply of power to the heater when the level of combustion gas reaches a stop level;

monitor the level of combustion gas after the controller has stopped the supply of power to the heater, and activate an indicator if the level of combustion gas remains above the stop level; and activate another indicator when the level of combustion gas exceeds a threshold gas level.

* * * * *